US010607796B2

(12) United States Patent
Dixit et al.

(10) Patent No.: US 10,607,796 B2
(45) Date of Patent: Mar. 31, 2020

(54) ELECTRICAL SWITCHING APPARATUS WITH SPRINGS AND SHUNT TRIP MECHANISM

(71) Applicant: Eaton Corporation, Cleveland, OH (US)

(72) Inventors: Rishabh Dixit, Pune (IN); Richard Prohaska, Cleveland, TN (US); Romil Vaishnavi, Midc (IN); Somnath Devarde, Midc (IN); Prashant Savgave, Magarpatta (IN)

(73) Assignee: Eaton Intelligent Power Limited, Dublin (IE)

( * ) Notice: Subject to any disclaimer, the term of this patent is extended or adjusted under 35 U.S.C. 154(b) by 105 days.

(21) Appl. No.: 15/797,303

(22) Filed: Oct. 30, 2017

(65) Prior Publication Data

US 2019/0131090 A1 May 2, 2019

(51) Int. Cl.

| | |
|---|---|
| ***H01H 21/22*** | (2006.01) |
| ***H01H 21/42*** | (2006.01) |
| ***H01H 9/26*** | (2006.01) |
| *H01H 3/30* | (2006.01) |
| *H01H 71/12* | (2006.01) |

(52) U.S. Cl.

CPC ..... *H01H 21/22* (2013.01); *H01H 9/26* (2013.01); *H01H 21/42* (2013.01); *H01H 3/3005* (2013.01); *H01H 3/3042* (2013.01); *H01H 71/12* (2013.01); *H01H 2235/01* (2013.01)

(58) Field of Classification Search

CPC ..... H01H 21/22; H01H 21/42; H01H 2235/01
USPC ..... 200/335
See application file for complete search history.

(56) References Cited

U.S. PATENT DOCUMENTS

2013/0214885 A1* 8/2013 Prohaska ..... H01H 83/20 335/172

* cited by examiner

*Primary Examiner* — Edwin A. Leon
*Assistant Examiner* — Iman Malakooti
(74) *Attorney, Agent, or Firm* — Benesch Friedlander Coplan & Aronoff LLP (Eaton)

(57) ABSTRACT

An apparatus includes a switch having alternately open and closed conditions, and a shunt trip mechanism configured to detect and respond to an electrical fault condition. The apparatus further includes an operating mechanism including a spring assembly. The operating mechanism is actuatable manually to deflect the spring assembly into a stressed condition, and is actuatable automatically in response to the shunt trip mechanism to shift the switch into the open condition upon return deflection of the spring assembly from the stressed condition. The spring assembly may include springs connected in parallel.

20 Claims, 3 Drawing Sheets

ELECTRICAL SWITCHING APPARATUS WITH SPRINGS AND SHUNT TRIP MECHANISM

TECHNICAL FIELD

This technology relates to an apparatus that opens an electrical switch upon detecting an electrical fault condition.

BACKGROUND

An enclosed electrical switch, such as a safety switch or disconnect, may be shifted between open and closed conditions manually by the use of a handle at the exterior of the enclosure in which the switch is contained. The enclosed switch may also be shifted into the open condition automatically by the use of a shunt trip mechanism enclosed with the switch. The shunt trip mechanism may be connected with the switch by an operating mechanism that applies a spring bias to open the switch in response to an electrical fault condition detected by the shunt trip mechanism. The spring may first be charged in a stressed condition manually by movement of the handle. The shunt trip mechanism may then respond to the electrical fault condition by releasing the charged spring automatically in response to the electrical fault condition, and thereby permitting return deflection of the spring to open the switch automatically.

SUMMARY

An apparatus includes a switch having alternately open and closed conditions, and a shunt trip mechanism configured to detect and respond to an electrical fault condition. The apparatus further includes an operating mechanism with a spring assembly. The operating mechanism is actuatable manually to deflect the spring assembly into a stressed condition. The operating mechanism is also actuatable automatically in response to the shunt trip mechanism to shift the switch into the open condition upon return deflection of the spring assembly from the stressed condition. The spring assembly may include springs connected in parallel.

The apparatus may include a handle. The operating mechanism may be configured to shift the switch into the closed condition upon movement of the handle manually in a closing direction. The operating mechanism may be actuatable manually to deflect the spring assembly into a stressed condition upon movement of the handle manually in the closing direction, and may be also be actuatable automatically in response to the shunt trip mechanism to shift the switch into the open condition upon return deflection of the spring assembly from the stressed condition. The springs may be connected in parallel between the handle and the switch.

Summarized differently, an apparatus includes a switch, a shunt trip mechanism, and an operating output member. The operating output member is configured to shift the switch into an open condition upon rotating about the first axis in an opening direction. A first spring is wound around the first axis. The first spring is interconnected with the shunt trip mechanism and the operating output member to apply a first spring bias that drives the operating output member in the opening direction in response to actuation of the shunt trip mechanism. A second spring is remote from the first spring and the first axis. A linkage is connected between the second spring and the operating member to apply a second spring bias that drives the operating output member in the opening direction in parallel with the first spring bias. A second linkage may be connected between a handle and the second spring to deflect the second spring into a stressed condition upon movement of the handle manually toward a closed position.

DETAILED DESCRIPTION

Figure 1:
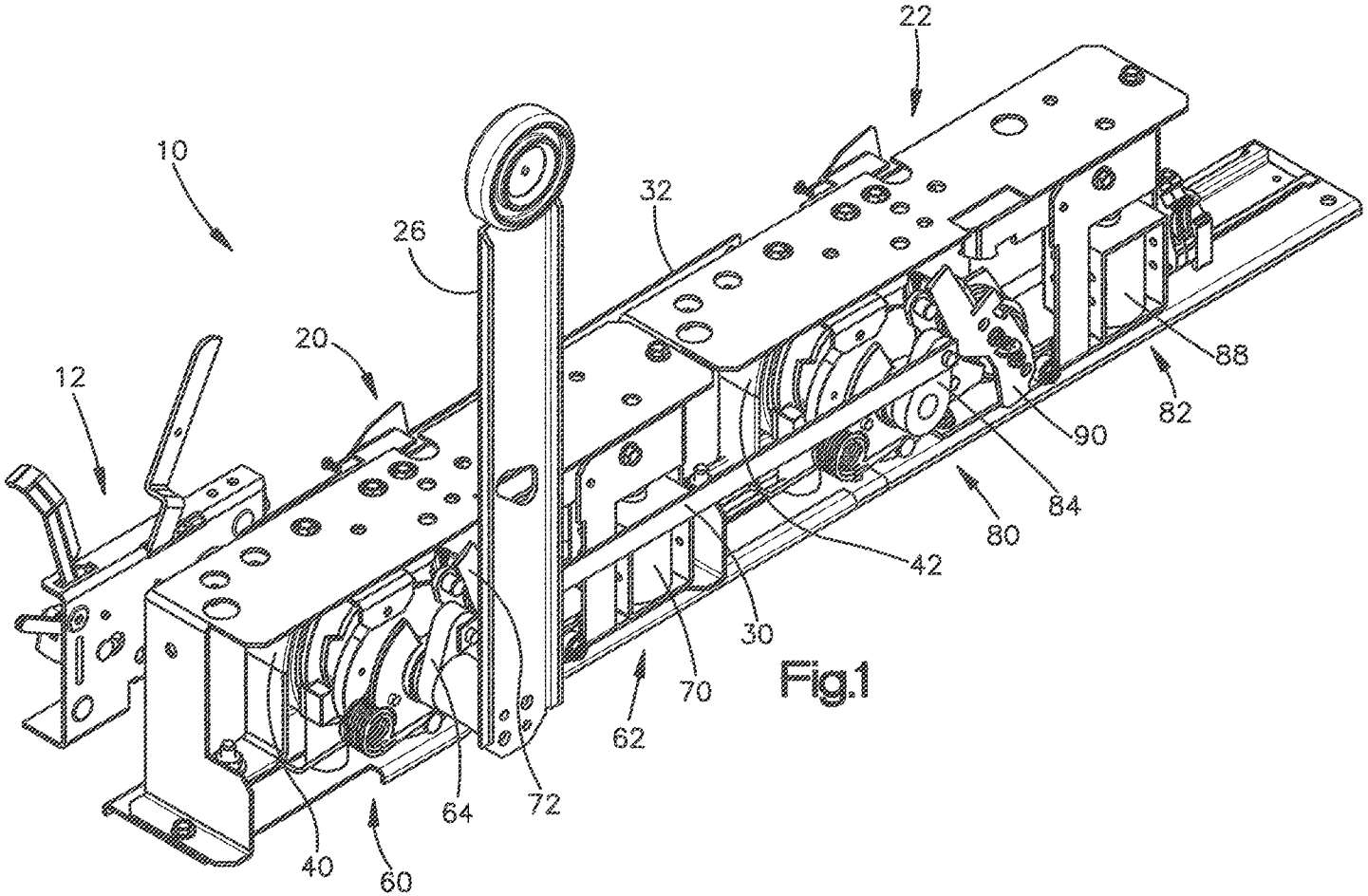
FIG. 1 is a front perspective view of an electrical switching apparatus including springs and a shunt trip mechanism.

The embodiments illustrated in the drawings have parts that are examples of the elements recited in the claims. The illustrated embodiments thus include examples of how a person of ordinary skill in the art can make and use the claimed invention. They are described here to meet the enablement and best mode requirements of the patent statute without imposing limitations that are not recited in the claims. One or more of the elements of one embodiment may be used in combination with, or as a substitute for, one or more elements of another as needed for any particular implementation of the claimed invention.

As shown in FIG. 1, an apparatus 10 includes a switch 12 and a pair of switching modules 20 and 22. The switch 12 and the switching modules 20, 22 are configured for enclosure in a cabinet (not shown). A handle 26 is configured engage the apparatus 10 through an opening in the cabinet.

The switching modules 20 and 22 are substantially alike, and are interconnected by linkages 30 and 32. The linkages 30, 32 enable the modules 20, 22 to cooperate in shifting the switch 12 between open and closed conditions. Specifically, the switching modules 20, 22 include respective opening springs 40 and 42. The linkages 30, 32 connect the opening springs 40 and 42 in parallel between the handle 26 and the switch 12.

Figure 2:
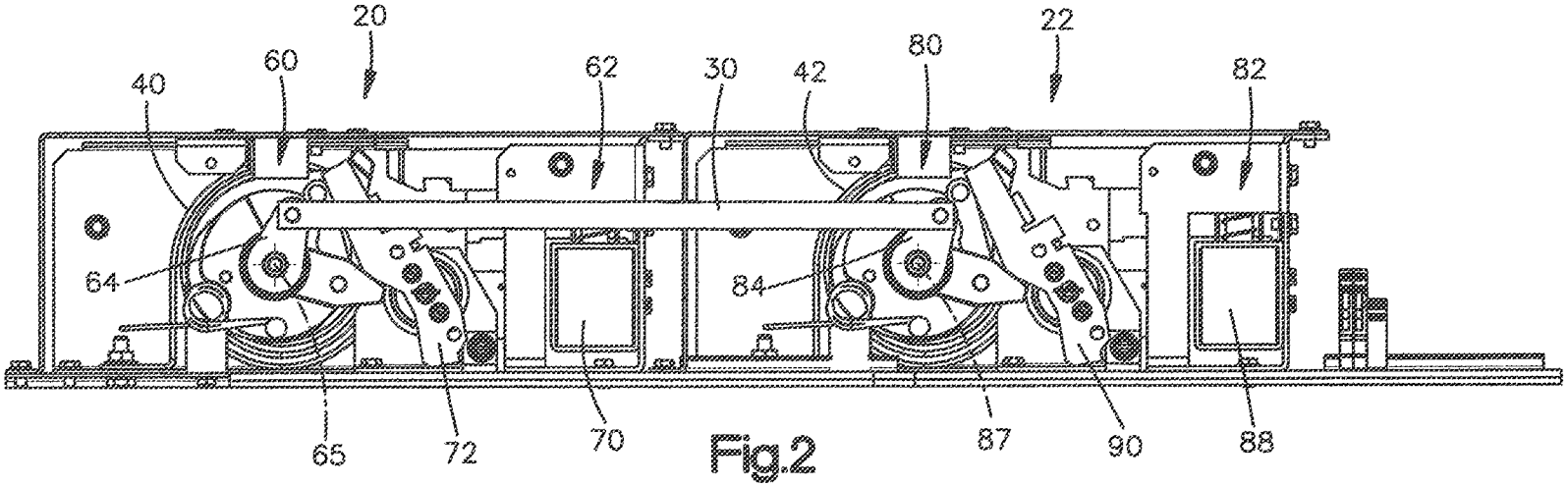
FIG. 2 is front view of the apparatus of FIG. 1.
Figure 3:
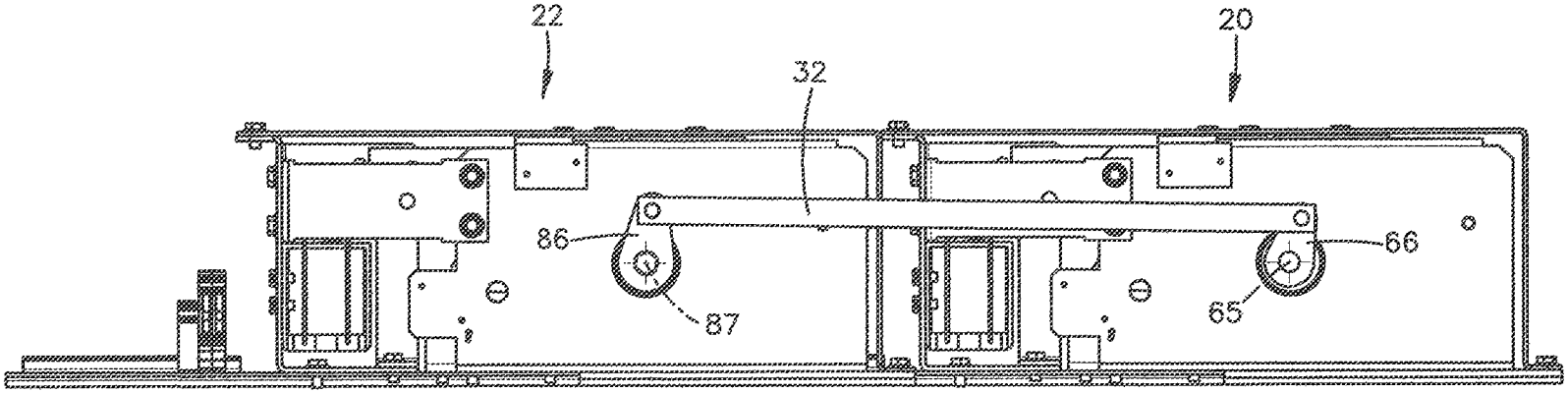
FIG. 3 is a rear view of the apparatus of FIG. 1.

As best shown in FIG. 2, the first switching module 20 includes an operating mechanism 60 and a shunt trip mechanism 62. Both the operating mechanism 60 and the shunt trip mechanism 62 are configured substantially as disclosed in U.S. Pat. No. 8,629,744, which is incorporated by reference in its entirety. Accordingly, the operating mechanism 60 includes a coupling 64 (FIG. 2) supported for rotation about an axis 65. An output member 66 at the opposite side (FIG. 3) of the first module 20 is supported for rotation about the axis 65 with the coupling 64. The output member 66 is connected with the switch 12 to shift the switch 12 into the closed condition when rotating about the axis 65 in a closing direction, and to shift the switch 12 into the open condition when rotating about the axis 65 oppositely in an opening direction.

The handle 26 is supported on the coupling 64 to move pivotally about the axis 65 from the intermediate position of FIG. 1 toward a closed position to the left as viewed in FIG. 1, and toward an open position to the right as viewed in FIG. 1. The coupling 64 and the output member 66 rotate back and forth in the opening and closing directions with such pivotal movement of the handle 26. When the handle 26 is thus moved manually toward and into the closed position, the operating mechanism 60 deflects the corresponding opening spring 40 into a stressed condition. The operating mechanism 60 then retains the opening spring 40 in the stressed condition until released.

The shunt trip mechanism 62 includes a solenoid 70 configured to detect and respond to an electrical fault condition. The shunt trip mechanism 62 includes a spring-loaded latch 72 that responds to the solenoid 70 by releasing the operating mechanism 60 to permit return deflection of the opening spring 40 from the stressed condition. The biasing force of such return deflection at the opening spring 40 rotates the output member 66 in the opening direction to open the switch 12.

When the shunt trip mechanism 62 releases the operating mechanism 60 to open the switch 12, the operating mechanism 60 further acts to move the handle 26 back in the opening direction automatically from the closed position to an intermediate position. This provides a visual indication that the switch 12 has been opened automatically. The switch 12 can also be opened manually by moving the handle 26 back from the closed position to the intermediate position. In either case, the operating mechanism 60 can be reset in the closed condition, with the opening spring 40 again charged in the stressed condition, by moving the handle 26 further from the intermediate position to the open position, and then fully back past the intermediate position to the closed position.

Like the first switching module 20, the second switching module 22 includes an operating mechanism 80 and a shunt trip mechanism 82. These mechanisms 80 and 82 also are configured substantially as disclosed in the above-noted U.S. Pat. No. 8,629,744 which is incorporated herein by reference. The operating mechanism 80 at the second module 22 thus includes a coupling 84 (FIG. 2) an output member 86 (FIG. 3) supported to rotate together about an axis 87. The shunt trip mechanism 82 at the second module 22 likewise includes a solenoid 88 configured to detect and respond to an electrical fault condition. A spring-loaded latch 90 responds to the solenoid 88 by acting on the operating mechanism 80 to release the respective opening spring 42 for return deflection from a stressed condition.

In the illustrated example, the axis 87 at the second module 22 is parallel to, and is spaced radially from, the axis 65 at the first module 20. The opening spring 40 at the first module 20 is a spiral spring that is wound around the first axis 65. The opening spring 42 at the second module 22 is a spiral spring that is wound around the second axis 87.

The first linkage 30 (FIG. 2) connects the coupling 64 at the first module 20 with the coupling 84 at the second module 22. This enables the handle 26 to rotate both couplings 64 and 84 simultaneously, and thereby to charge both opening springs 40 and 42 into the stressed condition simultaneously, upon movement of the handle 26 into the closed position. The operating mechanism 80 at the second module 22 then retains the respective opening spring 42 in the stressed condition until released by actuation of the corresponding shunt trip mechanism 82.

The second linkage 32 (FIG. 3) interconnects the output member 86 at the second module 20 with the output member 66 at the first module 20. This connection transmits the force of return deflection from the second opening spring 42 to the output member 66 at the first module 20. As a result, the biasing forces of return deflection at the two opening springs 40 and 42 are applied to the output member 66 in parallel, and are applied from the output member 66 to the switch 12 simultaneously.

Figure 4:
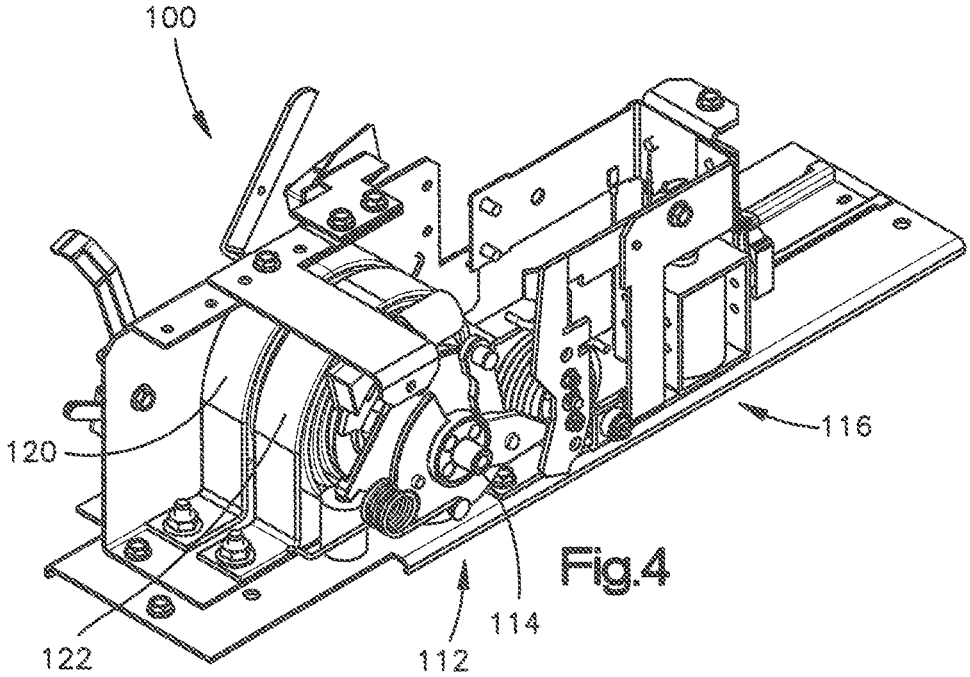
FIG. 4 is a front perspective view of an alternative electrical switching apparatus including springs and a shunt trip mechanism.

Parts of an alternative embodiment of a switching module 100 are shown in FIG. 4. This switching module 100 includes an operating mechanism 112 with a coupling 114 for a handle. The module 100 of FIG. 4 also includes a shunt trip mechanism 116. The shunt trip mechanism 116 detects and responds to an electrical fault condition by releasing the corresponding operating mechanism 112 to open a switch under the biasing forces of return deflection at a pair of opening springs 120 and 122 that are connected in parallel. In this embodiment the opening springs 120 and 122 are coaxial spiral springs that both act directly on the operating mechanism 112.

Figure 5:
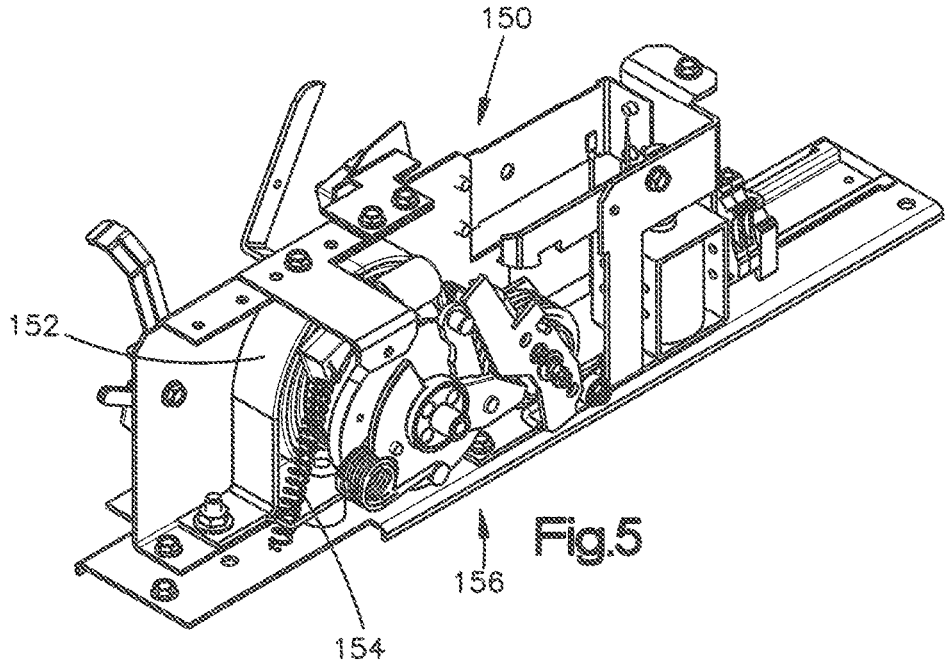
FIG. 5 is a front perspective view of another alternative electrical switching apparatus including springs and a shunt trip mechanism.

Parts of another embodiment of a switching module 150 are shown in FIG. 5. This switching module 150 is substantially the same as the switching module 100 of FIG. 4, but the parallel opening springs include a spiral spring 152 and a coil spring 154 that both act directly on the corresponding operating mechanism 156.

This written description sets for the best mode of carrying out the invention, and describes the invention so as to enable a person of ordinary skill in the art to make and use the invention, by presenting examples of the elements recited in the claims. The detailed descriptions of those elements do not impose limitations that are not recited in the claims, either literally or under the doctrine of equivalents.

What is claimed is:

1. An apparatus comprising:

a switch having alternately open and closed conditions;

a shunt trip mechanism configured to detect and respond to an electrical fault condition;

an operating mechanism including a spring assembly, wherein the operating mechanism is actuatable manually to deflect the spring assembly into a stressed condition, and is actuatable automatically in response to the shunt trip mechanism to shift the switch into the open condition upon return deflection of the spring assembly from the stressed condition;

wherein the spring assembly comprises springs connected in parallel;

wherein the springs include a first spiral spring wound about a first axis and a second spiral spring wound around a second axis spaced from the first axis and the first spiral spring;

a handle supported for movement pivotally about the first axis in opening and closing directions; and a first linkage operatively connected between the handle and the second spiral spring to deflect the second spiral spring into the stressed condition upon movement of the handle manually in the closing direction, and a second linkage operatively connected between the second spiral spring and the switch to shift the switch into the open condition upon return deflection of the second spiral spring from the stressed condition.

2. An apparatus as defined in claim 1, further comprising an additional shunt trip mechanism configured to detect and respond to an electrical fault condition, and a second operating mechanism that is actuatable automatically in response to the additional shunt trip mechanism to enable return deflection of the second spring from the stressed condition.

3. An apparatus as defined in claim 1, wherein the operating mechanism is further configured to shift the switch into the open condition upon movement of the handle manually in the opening direction.

4. An apparatus as defined in claim 1, wherein the operating mechanism is further configured to move the handle in the opening direction automatically in response to the shunt trip mechanism.

5. An apparatus comprising:

a switch having alternately open and closed conditions;

a shunt trip mechanism configured to detect and respond to an electrical fault condition;

a handle; and an operating mechanism including a spring assembly, wherein the operating mechanism is configured to shift the switch into the closed condition upon movement of the handle manually in a closing direction, is actuatable manually to deflect the spring assembly into a stressed condition upon movement of the handle manually in the closing direction, and is actuatable automatically in response to the shunt trip mechanism to shift the switch into the open condition upon return deflection of the spring assembly from the stressed condition;

wherein the spring assembly comprises springs connected in parallel between the handle and the switch;

wherein the springs include a first spiral spring wound around a first axis and a second spiral spring wound around a second axis spaced from the first axis and the first spiral spring;

wherein the handle is supported for movement pivotally about the first axis; and further comprising a first linkage operatively connected between the handle and the second spiral spring to deflect the second spiral spring into the stressed condition upon movement of the handle manually in the closing direction, and a second linkage operatively connected between the second spiral spring and the switch to shift the switch into the open condition upon return deflection of the second coil spring from the stressed condition.

6. An apparatus as defined in claim 5, further comprising an additional shunt trip mechanism configured to detect and respond to an electrical fault condition, and a second operating mechanism that is actuatable automatically in response to the additional shunt trip mechanism to enable return deflection of the second spring from the stressed condition.

7. An apparatus as defined in claim 5, wherein the operating mechanism is further configured to shift the switch into the open condition upon movement of the handle manually in the opening direction.

8. An apparatus as defined in claim 5, wherein the operating mechanism is further configured to move the handle in the opening direction automatically in response to the shunt trip mechanism.

9. An apparatus comprising:

a switch having alternately open and closed conditions;

a shunt trip mechanism configured to detect and respond to an electrical fault condition;

an operating mechanism including a spring assembly, wherein the operating mechanism is actuatable manually to deflect the spring assembly into a stressed condition, and is actuatable automatically in response to the shunt trip mechanism to shift the switch into the open condition upon return deflection of the spring assembly from the stressed condition;

wherein the spring assembly comprises first and second springs connected in parallel between the handle and the switch;

a handle supported for movement manually in opening and closing directions; and a first linkage operatively connected between the handle and the second spring to deflect the second spring into the stressed condition upon movement of the handle in the closing direction, and a second linkage operatively connected between the second spring and the switch to shift the switch into the open condition upon return deflection of the second spring from the stressed condition.

10. An apparatus as defined in claim 9, further comprising an additional shunt trip mechanism configured to detect and respond to an electrical fault condition, and a second operating mechanism that is actuatable automatically in response to the additional shunt trip mechanism to enable return deflection of the second spring from the stressed condition.

11. An apparatus as defined in claim 9, wherein the operating mechanism is further configured to shift the switch into the open condition upon movement of the handle in the opening direction.

12. An apparatus as defined in claim 9, wherein the operating mechanism is further configured to move the handle in the opening direction automatically in response to the shunt trip mechanism.

13. An apparatus comprising:

a switch having alternately open and closed conditions;

a handle supported for movement manually in opening and closing directions;

a shunt trip mechanism configured to detect and respond to an electrical fault condition;

an operating mechanism including a first spring, wherein the operating mechanism is actuatable manually to deflect the first spring into a stressed condition upon movement of the handle in the closing direction, and is actuatable automatically in response to the shunt trip mechanism to shift the switch into the open condition upon return deflection of the first spring from the stressed condition;

a second spring;

a first linkage operatively connected between the handle and the second spring to deflect the second spring into a stressed condition upon movement of the handle manually in the closing direction; and and a second linkage operatively connected between the second spring and the switch to shift the switch into the open condition upon return deflection of the second spring from the stressed condition.

14. An apparatus as defined in claim 13, wherein the operating mechanism includes an output member configured to shift the switch into the open condition upon rotating in an opening direction, and the second linkage is operatively connected between the second spring and the output member to rotate the output member in the opening direction upon return deflection of the second spring from the stressed condition.

15. An apparatus as defined in claim 13, further comprising an additional shunt trip mechanism configured to detect and respond to an electrical fault condition, and a second operating mechanism that is actuatable automatically in response to the additional shunt trip mechanism to enable return deflection of the second spring from the stressed condition.

16. An apparatus as defined in claim 13, wherein the first spring is a spiral spring wound about a first axis.

17. An apparatus as defined in claim 13, wherein the second spring is a spiral spring wound around a second axis spaced radially from the first axis and the first spiral spring.

18. An apparatus as defined in claim 13, wherein the handle is supported for movement pivotally about the first axis in the opening and closing directions.

19. An apparatus as defined in claim 13, wherein the operating mechanism is further configured to shift the switch into the open condition upon movement of the handle in the opening direction.

20. An apparatus as defined in claim 13, wherein the operating mechanism is further configured to move the handle in the opening direction automatically in response to the shunt trip mechanism.

* * * * *